US006052826A

United States Patent [19]

Tolton

[11] Patent Number: 6,052,826

[45] Date of Patent: Apr. 25, 2000

[54] WATERPROOF PLEATS FOR ACTIVE WEAR GARMENT AND METHOD OF FORMING SAID PLEATS

[76] Inventor: Gary A. Tolton, 1025 Lombard Rd., Red Lion, Pa. 17356

[21] Appl. No.: 09/035,099

[22] Filed: Mar. 5, 1998

[51] Int. Cl.[7] ..... A41D 3/02

[52] U.S. Cl. ..... 2/87; 2/93; 2/108

[58] Field of Search ..... 2/85, 87, 93, 106, 2/108, 115, 275, 82, DIG. 5, 2.15, 97, 120, 121, 122, 243.1, 272

[56] References Cited

U.S. PATENT DOCUMENTS

| | | | |
|---|---|---|---|
| 1,400,881 | 12/1921 | King | 2/115 |
| 1,703,808 | 2/1929 | Wright | 2/115 |
| 2,497,630 | 2/1950 | Roseen | 2/115 |
| 2,694,202 | 11/1954 | Macrides | 2/108 |
| 2,916,741 | 12/1959 | Weiser . | |
| 2,945,238 | 7/1960 | Weiser . | |
| 3,193,844 | 7/1965 | Eng . | |
| 3,327,319 | 6/1967 | Johnides | 2/85 |
| 3,819,467 | 6/1974 | Kovac | 161/113 |
| 4,561,128 | 12/1985 | Zimmerman | 2/275 |
| 4,608,715 | 9/1986 | Miler et al. | 2/87 |
| 4,665,563 | 5/1987 | Harvey . | |
| 4,803,109 | 2/1989 | Saniscalchi | 2/275 |
| 5,138,717 | 8/1992 | Tolton . | |
| 5,218,720 | 6/1993 | Tolton . | |

*Primary Examiner*—Amy B. Vanatta
*Attorney, Agent, or Firm*—Hoffman, Wasson & Gitler

[57] ABSTRACT

An outer garment for a variety of athletic endeavors is disclosed. The garment comprises an outer shell formed of a lightweight, waterproof material, and may include an inner liner material. The garment includes one or two front panels and a rear panel that are sewn together along seam lines that extend along the shoulders of the wearer; pleats extend downwardly from the seam lines and blend, or vanish, into the rear panel of the outer shell. The pleats are formed by a novel method employing the steps of cutting the folded fabric along a diagonal line, and then sewing the fabric together along the diagonal surfaces so that the pleat is watertight. The free ends of the overlapped fabric are then sealed by seam sealing tape. The tape extends downwardly below the seam. The resulting garment is form fitting, does not "bunch up" or gather about the torso of the wearer, and prevents moisture from gaining entry into the jacket through the pleats and seam lines between the front and rear panels of the garment.

9 Claims, 4 Drawing Sheets

WATERPROOF PLEATS FOR ACTIVE WEAR GARMENT AND METHOD OF FORMING SAID PLEATS

BACKGROUND OF THE INVENTION

1. Field of the Invention

The invention relates broadly to an outer garment, such as a jacket, that is suitable for golfers, runners, hunters, skiers, etc. More particularly, the invention relates to a waterproof outer garment employing pleats in the top/back portion of the outer shell and/or the inner liner of the garment, and to the method of forming such pleats.

2. Background of the Invention

Various attempts have been made to provide an outer garment, such as a jacket, that is suitable for wear by athletes participating in all kinds of strenuous activities and under widely varying climatic conditions. One approach has been relied upon a jacket comprising (1) an outer shell that is lightweight and waterproof, and has a porosity that allows perspiration vapor to escape, and (2) a mesh-like inner liner, and (3) manually operable fasteners that can be adjusted to facilitate tailoring of the front side of the jacket to fit snugly in the stomach and chest areas of the wearer.

The jacket described in the preceding paragraph is shown in U.S. Pat. Nos. 5,138,717 and 5,218,720, both granted to the instant applicant. The former patent further discloses a "piston and cylinder" cuff arrangement, while the latter patent further discloses the details of the inner liner of mesh-like material, including a yieldable insert, its location, and the interaction between the insert and the adjustable fasteners. Both patents show elongated pleats in the rear, or back, of the outer shell. Such pleats extend downwardly for considerable distances below the shoulders of the wearer.

While jackets predicated upon the disclosure of the two patents cited above have met with considerable commercial success, some problems have been encountered with moisture entering the jacket through the pleats. Also, the pleats have tended to bunch, or gather, and interfere with the swinging action of the wearer's arms, a particularly worrisome problem if the wearer is a golfer.

Other outer garments designed for athletic purposes are shown in U.S. Pat. No. 2,112,788, granted Mar. 29, 1938, to Gordon Rosenberg, and U.S. Pat. No. 4,665,563, granted May 19, 1987 to Marc Harvey. However, the Rosenberg and/or Harvey patents do not address the moisture problem and/or the bunching up problem associated with known active wear garments.

SUMMARY OF THE INVENTION

Thus, with the deficiencies of known outer wear garments clearly in mind, the present invention contemplates an outer garment that relies upon uniquely formed pleats, located at strategic locations, which insures uniform and non-restrictive expansion in the rear panel of the jacket. The pleats vanish, or blend, into the back of the outer shell, are aesthetically pleasing, and do not compromise the sleek lines of the jacket. Furthermore, the pleats are formed by a novel method, so that the pleats are sealed at all times and moisture does not enter the jacket through the pleats to insure that the garment is waterproof, even under harsh climatic conditions and after going through many machine washings.

The novel method includes the steps of cutting out the back of the garment, removing diagonal notches therefrom, overlapping sections of material along a diagonal line, sewing the overlapped sections together, and sealing the exposed ends of the cut, overlapped sections with seam sealing tape. The resultant pleat is waterproof yet esthetically pleasing.

The shell of the garment is then completed by sewing the front and rear panels together along seam lines, that will be located on the shoulders of the wearer. Seam sealing tape is applied across the seam lines in the shoulder area to preclude moisture from entering the garment through such seams, and to compliment the effectiveness of the previously formed waterproof and/or watertight pleats.

Other advantages attributable to the instant invention will occur to the skilled artisan when the appended drawings are construed in harmony with the specification and claims of the instant application.

DETAILED DESCRIPTION OF THE INVENTION

Figure 1:
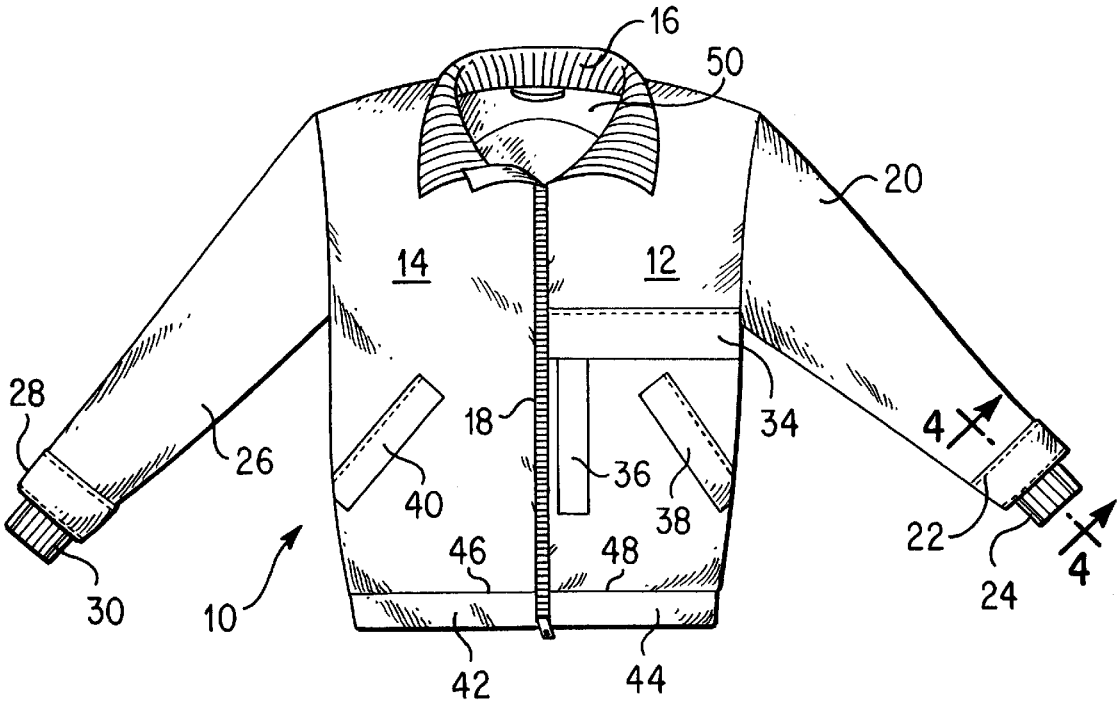
FIG. 1 PRIOR ART
FIG. 1 is a front elevational view of a known active-wear jacket, such view being shown in its closed position.

Referring now to the drawings, FIG. 1 shows the front of a jacket constructed in accordance with the disclosure of U.S. Pat. Nos. 5,138,717 and 5,218,720.

Jacket 10 comprises an outer shell that is lightweight, waterproof, and has sufficient porosity to allow perspiration vapor to escape; one commercially available material that fits these criteria is a texturized polyester two-layer film, manufactured by G. L. Gore and Associates, Inc., of Elkton, Md. 21920-0729 under the mark GORE-TEX. Jacket 10 includes a first front panel 12, a second front panel 14, and a collar 16 that extends about the neck of the wearer. A zipper 18, when operated, secures the panels 12, 14 together. A first sleeve 20 is secured to the body of the jacket in the area of intersection with panel 12; a cuff 22 is defined at the free end of first sleeve 20, and a wristlet 24 extends beyond the cuff 22. A second sleeve 26 is secured to the body of the jacket in the area of intersection with panel 14; a cuff 28 is defined at the free end of sleeve 26, and a wristlet 30 extends beyond the cuff 28.

A flap 34 extends horizontally across the panel. A vertically oriented flap 36 protects the entrance into a deep pocket defined between the panel 12 and the inner liner of the jacket, while a diagonally extending flap 38 protects the entrance into another pocket.

Another diagonal flap 40, on panel 14, protects the entrance into yet another pocket. The lower end of panel 14 terminates in a bottom section 42 of folded-over fabric, while the lower end of panel 12 terminates, similarly, in a bottom section 44 of folded-over fabric. The upper limit 46 of section 42 is indicated by a line of stitches, and the upper limit 48 of section 44 is indicated by a line of stitches. A segment of the inner liner of the jacket is visible in the vicinity of collar 16 in FIG. 1; the inner liner is indicated generally by reference numeral 50.

Figure 2:
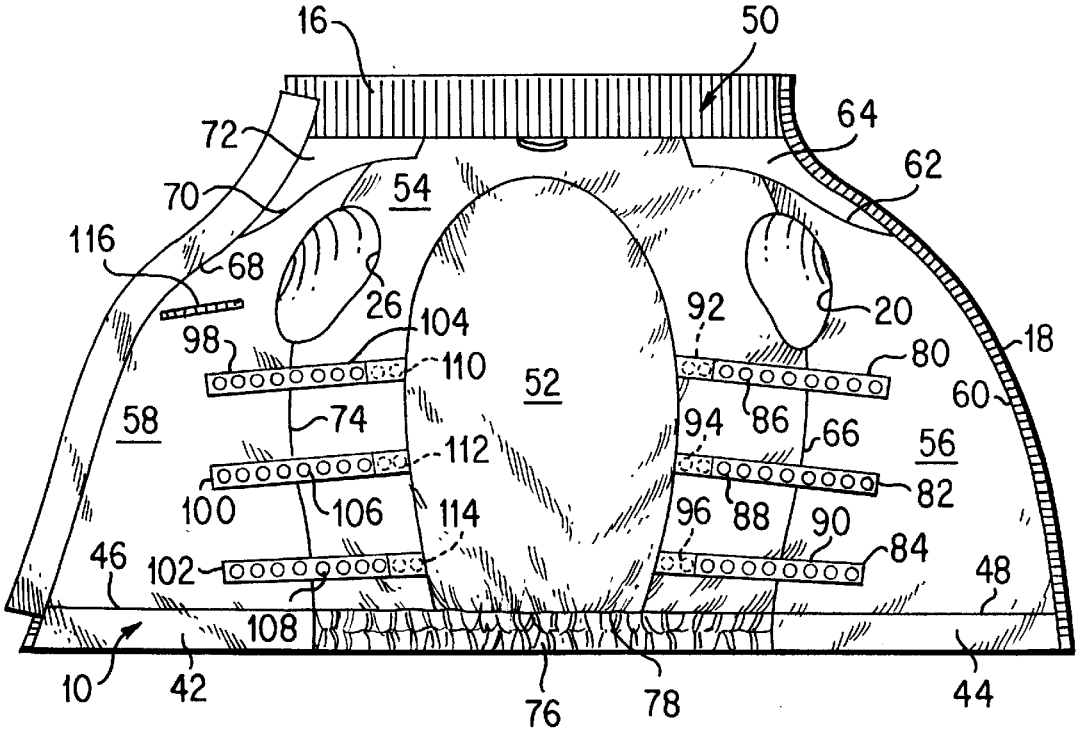
FIG. 2 PRIOR ART
FIG. 2 is a front elevational view of the jacket of FIG. 1, such jacket being shown in its opened condition to expose the liner used within the jacket.

FIG. 2 depicts jacket 10, in its opened condition, wherein zipper 18 has been unzipped, and panels 12, 14 have been folded back to reveal the details of inner liner 50. Liner 50 comprises a central, resilient, insert 52 that yields readily in all directions, a back panel 54, a first front panel 56, and a second front panel 58. Panels 54, 56 and 58 are all formed of a porous, mesh-like material. However, while insert 52 is fashioned from a readily yieldable material, panels 54, 56 and 58, are fashioned from a different, durable, but unyielding material. Consequently, insert 52 can be deformed relative to the supporting panels to which it is secured. Insert 52, which resembles an inverted U-shaped area, is sewn, or otherwise set, into the back panel 54 of the inner liner 50 of jacket 10. Insert 52 contacts the back of the wearer of the jacket. A suitable insert has been proven to be a 100% Dacron material.

One edge of first front panel 56 of the inner liner is sewn into engagement with the inner surface of panel 12 of the shell along stitch line 60; line 60 is located inwardly of zipper 18 and indicates the joinder of the zipper to the body of the jacket and side panel 56 of the liner. Front panel 56 is also secured to front panel 12 of the shell along line 48. Thus, the outer shell, and the inner liner, of the jacket move in concert.

Front panel 56 is also sewn along diagonal line 62 to interior tab 64 in the vicinity of the collar; the interior tab is made from the same material as the outer shell of the jacket. Front panel 56 and rear panel 54 of the liner are joined together by sewing along vertical line 66, with intersects the opening into sleeve 20.

One edge of second front panel 58 is sewn into engagement with the inner surface of panel 14 of the outer shell along stitch line 68. Line 68 is located inwardly of the zipper and indicates the joinder of the zipper to the body of the jacket and front panel 58 of the liner. Front panel 58 is also secured to front panel 14 along line 46. Since front panel 58 of the liner is secured to the front panel of the jacket, and vice versa, the shell and the inner liner of the jacket move in concert.

Front panel 58 is also sewn along diagonal line 70 to interior flap 72 in the vicinity of the collar; the interior tab is made from the same material as the outer shell of the jacket. Front panel 58 and rear panel 54 of the liner are joined together, by sewing along vertical line 74, which intersects the opening into sleeve 26.

An elastic section 76 is situated at the lower end of the back of the jacket, and such section fits between bottom sections 42 and 44. Section 76 is secured to the lower edges of the insert 52 and rear panel 54 of the inner liner.

Three, parallel, cloth straps 80, 82 and 84 extend horizontally across front panel 56 and rear panel 54 of the inner liner. Several receptacles 86 extend across the width of strap 80, several receptacles 90 extend across the width of strap 90. Snap buttons 92 are located on the end of strap 80 closest to inert 52, snap buttons 94 are located on the end of strap 82 closest to insert 52, and snap buttons 96 are located on the end of strap 84 closest to insert 52. Each strap is individually adjustable, by the simple expedient of pressing the snap fastener into the selected ones of the receptacles on the same strap.

In a similar fashion, three parallel cloth straps 98, 100 and 102 extend horizontally across front panel 58 and rear panel 54 of the inner liner. Several receptacles 104 extend across the width of strap 98, several receptacles 106 extend across the width of strap 100, and several receptacles 108 extend across the width of strap 102. Snap buttons 110 are located on the end of the strap 98 closest to insert 52, snap buttons 112 are located on the end of strap 100 closest to insert 52, and snap buttons 114 are located on the end of strap 102 closest to insert 52. Each strap is individually adjustable. An inner pocket 116 is formed in the inner liner, between the liner and the shell of the jacket.

To this juncture, the specification parallels U.S. Pat. Nos. 5,138,717 and 5,218,720; FIGS. 1 and 2 are designated as "Prior Art." Against such backdrop, the novel aspects of the instant invention are depicted in FIGS. 3–11.

Figure 3:
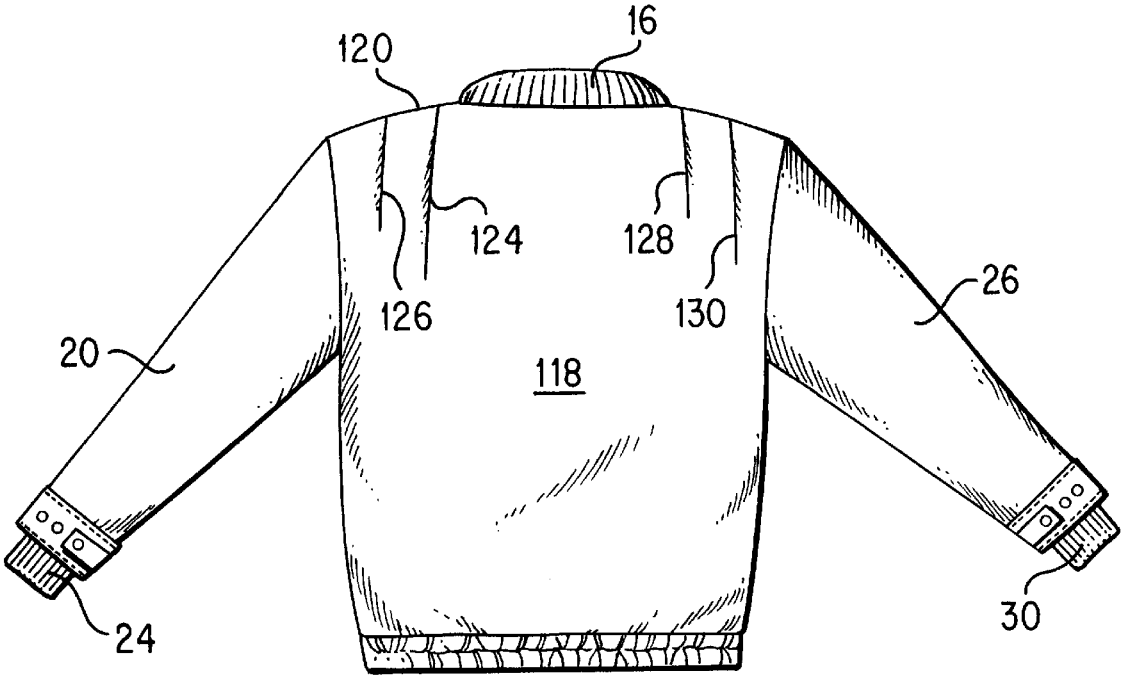
FIG. 3 is a rear elevational view of the jacket of FIG. 1, but showing pleats formed in accordance with the principles of the instant invention.
Figure 4:
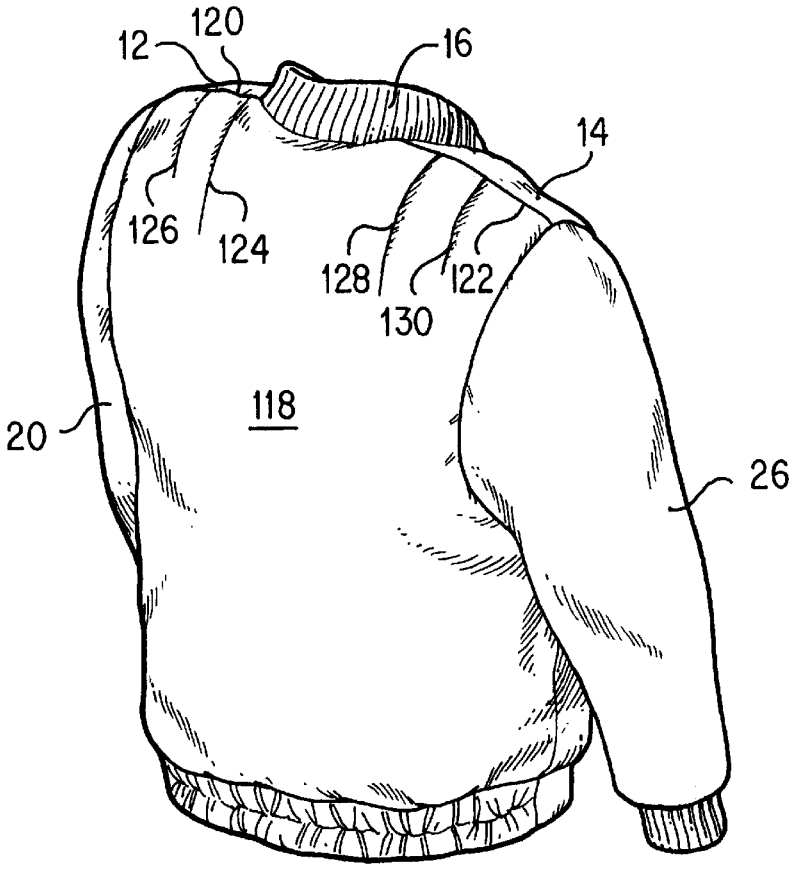
FIG. 4 is a perspective view of the rear of the jacket of FIG. 3, showing the relationship of the pleats with greater clarity.

To illustrate, FIGS. 3 and 4 show the back, or rear, 118 of the outer shell of jacket 10. Front panel 12 is secured to back 118 along seam 120, while front panel 14 is secured to back 118 along seam 122. Seams 120, 122 are located on the mid-sections of the shoulders of the person wearing jacket 10, and the seams follow the natural taper, or drop, of the shoulders of the wearer, as shown in FIG. 3.

A first pleat 124, and a second pleat 126, extend downwardly from seam 120, on one side of collar 16, and blend, or vanish, into the back 118 of jacket 10. Pleats 124, 126 are substantially parallel to each other, and extend downwardly, for a short distance from seam 120.

Similarly, a first pleat 128 and a second pleat 130 extend downwardly from seam 122, on the opposite side of collar 16, and blend, or vanish, into the back of jacket 10. Pleats 128, 130 are substantially parallel to each other. Pleats extend downwardly below the seam lines for a small fraction of the vertical dimension of back 118 of the outer shell of jacket 10. The location of pleats 124, 126; 128, 130, the extent of the pleats vis-a-vis the vertical dimension of back 118, and the orientation of the pleats, are all factors that contribute to the esthetic appeal of the pleats. The pleats, in turn, provide sufficient give, or tolerance, that the jacket does not become tight and uncomfortable on the body of the wearer, even when the wearer is swinging his, or her, arms vigorously, as may occur during driving a ball in a golf match.

Furthermore, pleats 124, 126, 128 and 130 are formed to be watertight, so that moisture can not enter the interior of jacket 10, even under wet and windblown conditions. A novel, relatively simple, and efficient method was developed to achieve the watertight, and/or waterproof, pleat.

Figure 5:
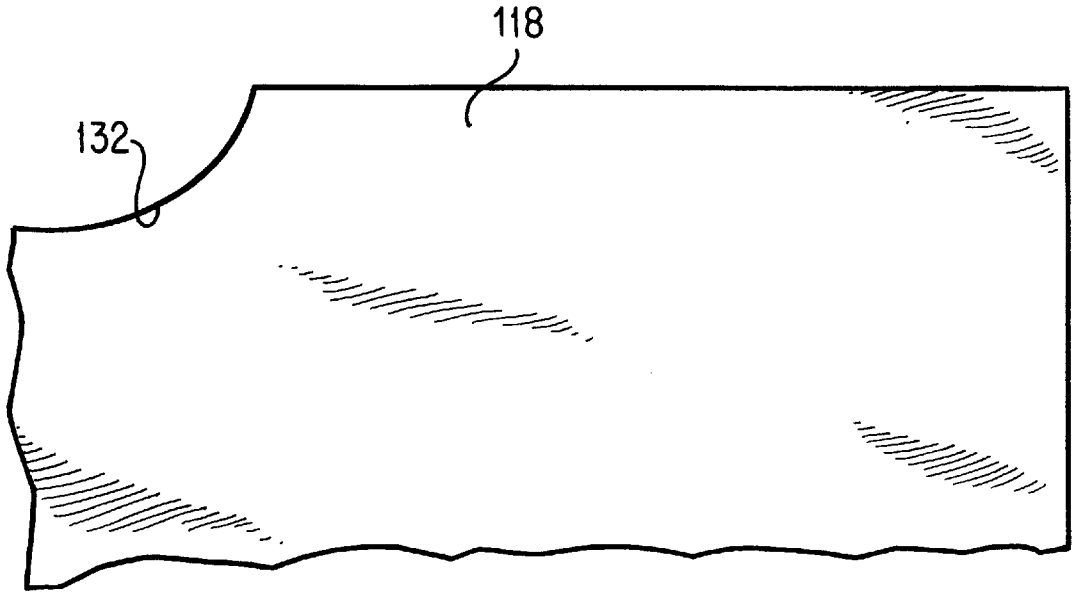
FIGS. 5–11 show the progression of steps in the unique method of forming pleats located in the top back portion of the active wear jacket of FIGS. 1–4.
Figure 6:
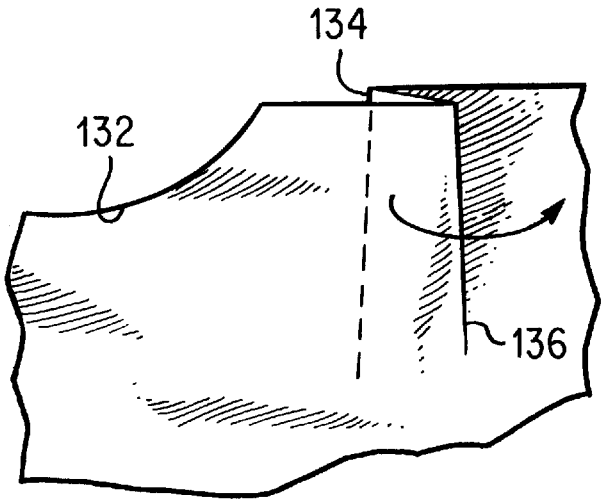

The process is shown, in progressive steps, in FIGS. 5, 6, 7, 8 and 9. FIG. 5 shows a fragment of the back, or rear, 118, of the outer shell of jacket 10; such fragment includes arcuate cut-out 132, which receives collar 16, (not shown in FIG. 5), has been cut from a roll or bolt of material (not shown). The shell is folded, in the vicinity of cut-out 132, about lines 134, 136, to define a Z-shaped fold, as shown in FIG. 6.

Figure 7:
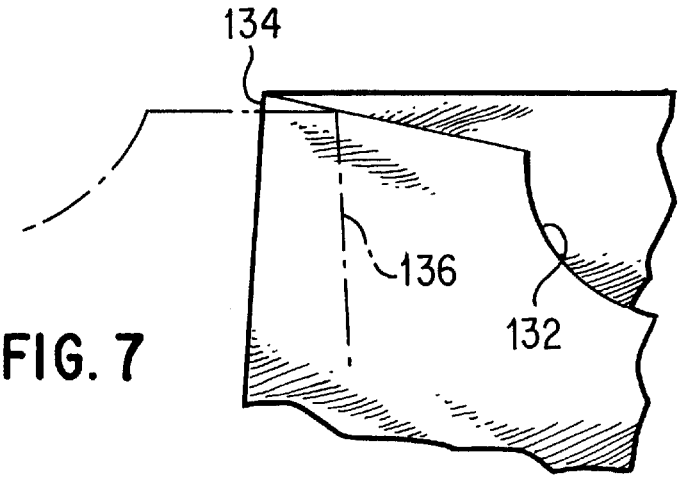

Next, the forward portion of the shell is pivoted about fold line 136, so that the forward portion of the shell overlaps the rearward portion of the shell, as shown in FIG. 7. The arcuate cut-out 132 is clearly visible.

Figure 8:
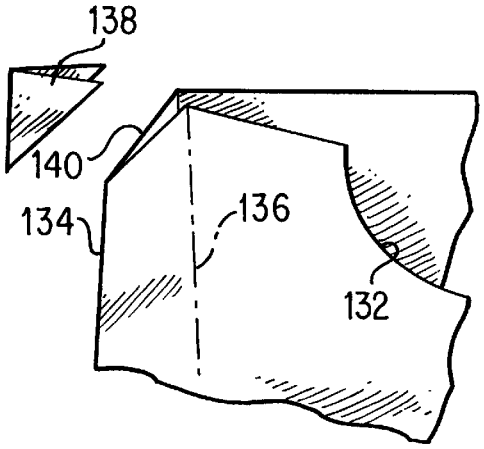
Figure 9:
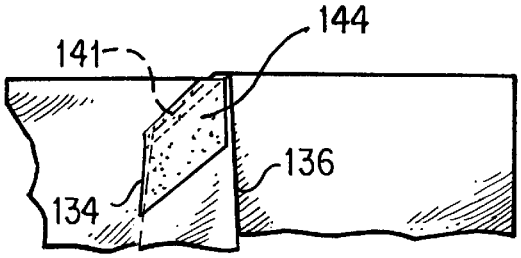

The exposed corner 138 of the overlapped shell is then removed, by cutting along diagonal line 140, as shown in FIG. 8. The remaining overlapped thicknesses of back 118 are then sewn together along seam line 141, spaced inwardly of the edges of the overlapped shell material, as shown in FIG. 9. The free ends of the overlapped thicknesses are then sealed by seam sealing tape 144, which extends below seam line 141.

Figure 10A:
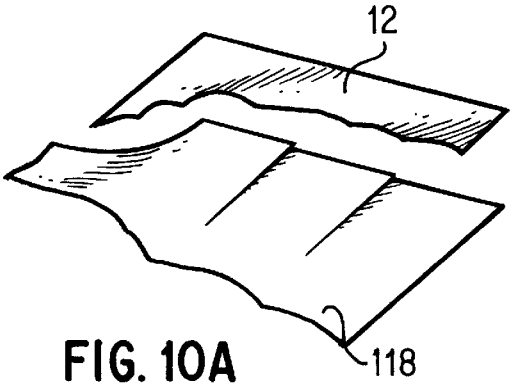
Figure 10B:
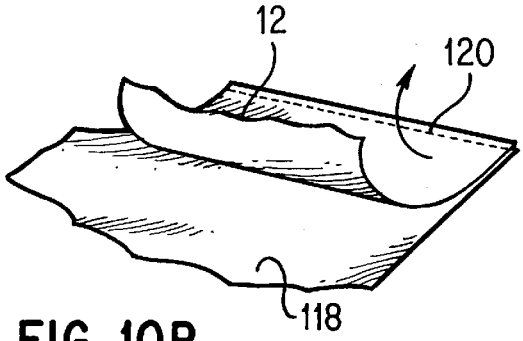

After two or more pleats, such as 124, 126; 128, 130 are formed, on either side of cut-out 132 and collar 16, the previously sewn and sealed rear panel 118 is secured to the front panels 12, 14 of the outer shell of jacket 10, as shown in FIGS. 10A and 10B, along seam 120.

Figure 11:
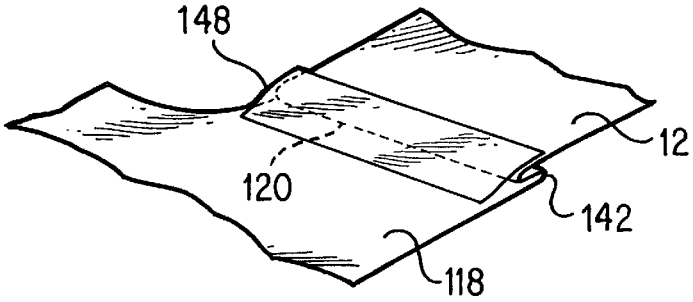

Lastly, as shown in FIG. 11, seam sealing tape 148 is applied over seam 120, to insure that moisture can not penetrate into the interior of the garment through the seam. Seam 122, on the other shoulder of the jacket, is sealed in the same fashion.

While the preferred embodiment of the active wear garment has been shown in FIGS. 3–4, and the method for forming a waterproof pleat has been shown in FIGS. 5–11, other revisions, modifications, and refinements may occur to the skilled artisan. For example, the jacket may be formed as a pull-over garment, and a unitary front panel would be used in lieu of panels 12 and 14. Collar 16 may also be omitted. The garment may consist only of an outer shell and the liner may be omitted. The pleats maybe formed in the outer shell, or, if warranted, in both the outer shell and inner liner. The seams on the garment may be overlapped to further enhance its water-resistant and/or waterproof characteristics. Also, while method of forming the pleats is depicted as a series of discrete steps, production techniques rely upon a unique pattern to accomplish several of the steps, and permit the manufacture of the garment on an economically feasible basis. Thus, the appended claims should be broadly construed, in a manner consistent with the significant advances in the useful arts and sciences realized by the instant invention. The claims of record should not be limited to their exact, literal meaning, but should be accorded reasonable scope and protection.

I claim:

1. An outer garment suitable for wear during athletic activities under differing climatic conditions, a) said garment being formed of a waterproof material having sufficient porosity to allow perspiration vapor from the body of the wearer to escape therethrough, b) said garment comprising at least one front panel and a back panel, c) said back panel being secured to the at least one front panel along a seam line located on the shoulders of the wearer of said garment, d) pleats extending downwardly from said seam line, said pleats vanishing into the back panel of said garment below said seam line, e) the invention being characterized in that said pleats are formed by overlapped layers of said waterproof material being permanently joined together, with waterproof seam sealing tape being applied over the free ends of said overlapped layers to prevent moisture from entering the garment through said pleat.

2. An outer garment as defined in claim 1 wherein a section is removed from the free ends of the overlapped layers adjacent to said seam line, and the overlapped layers are permanently joined together along a diagonal line formed by the removal of said section.

3. An outer garment as defined in claim 2 wherein the overlapped layers are permanently joined together by sewing.

4. An outer garment as defined in claim 2 wherein the section that is removed from the overlapped layers is triangular in shape.

5. An outer garment as defined in claim 2 wherein said overlapped layers, with said sealing tape applied thereto, are secured within said garment in the vicinity of the shoulders of the wearer of the garment.

6. An outer garment as defined in claim 5 wherein waterproof seam sealing tape is applied to the interior of said garment to cover said seam line and prevent moisture from entering the interior of said garment.

7. An outer garment suitable for wear during athletic activities under differing climatic conditions, a) said garment being formed of a waterproof material having sufficient porosity to allow perspiration vapor from the body of the wearer to escape therethrough, b) said garment comprising a front panel and a back panel, c) said back panel being secured to said front panel along a seam line located on the shoulders of the wearer of said garment, d) pleats extending downwardly from said seam line, e) said pleats being formed by overlapped layers of material in said back panel being permanently joined together, f) waterproof seam sealing tape being applied over the free ends of said overlapped layers of material to prevent moisture form entering the garment through said pleats.

8. An outer garment as defined claim 7 wherein triangular sections are removed from the free ends of said overlapped layers before said seam sealing tape is applied thereto, and said overlapped layers are permanently joined by sewing extending along a diagonal line formed in the remainder of the overlapped layers of material.

9. An outer garment as defined in claim 8 wherein waterproof seam sealing tape is applied to the interior of said garment to cover said seam line and prevent moisture from entering the interior of said garment, and said pleats vanish into the back panel of said garment below said seam line.

* * * * *